US006254086B1

(12) United States Patent
Sunou et al.

(10) Patent No.: US 6,254,086 B1
(45) Date of Patent: Jul. 3, 2001

(54) SHEET ACCOMMODATING DEVICE

(75) Inventors: Kazuo Sunou; Junji Shirakawa; Takayuki Muneyasu, all of Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 09/605,428

(22) Filed: Jun. 29, 2000

(30) Foreign Application Priority Data

Jul. 2, 1999 (JP) ..... 11-188319

(51) Int. Cl.[7] ..... B65H 1/00
(52) U.S. Cl. ..... 271/171
(58) Field of Search ..... 271/171

(56) References Cited

U.S. PATENT DOCUMENTS 5,215,303 * 6/1993 Yamada et al. ..... 271/171 X
6,089,566 * 7/2000 Xu et al. ..... 271/171 X

FOREIGN PATENT DOCUMENTS 63-258323 * 10/1988 (JP) ..... 271/171
5-294471 * 11/1993 (JP) ..... 271/171

* cited by examiner

*Primary Examiner*—David H. Bollinger
(74) *Attorney, Agent, or Firm*—Sughrue, Mion, Zinn, Macpeak & Seas, PLLC

(57) ABSTRACT

A sheet accommodating device comprises a first pinion (39*a*) rotatably disposed at a center of a table; second, third, fourth, and fifth pinions (39) which are rotatably disposed on the both sides of the table; a first regulating member (34) which has rack portions (36, 38) that can be engaged with the first pinion, second pinion and fourth pinion; a second regulating member (35) which has rack portions (37, 38) that can be engaged with the first pinion, third pinion and fifth pinion; and lock means (33) for positioning any one of the first and second regulating members.

12 Claims, 4 Drawing Sheets

SHEET ACCOMMODATING DEVICE

BACKGROUND OF THE INVENTION

1. Field of the Invention

The present invention relates to a sheet accommodating device which is applied to a paper supplying section or a paper exhausting section of an image forming apparatus such as a laser printer, a copier, or the like.

2. Description of the Related Art

A sheet accommodating device applied to an image forming apparatus can be broadly classified into a small-sized type in which the sheet capacity is about 250 to 500 sheets, and a large-sized type in which the sheet capacity is about several thousands sheets.

Recently, a sheet accommodating device has been widely used, in which a regulating member for regulating a sheet position is provided so that the regulating member can be moved according to a size of a sheet to be used and so that it can correspond various sizes of sheets.

In case of the large-sized type of the sheet accommodating device, the corresponding depth is required. Therefore, the large-sized type of sheet accommodating device must be equipped with a regulating member having several times as large as a regulating member in the small-sized type of sheet accommodating device has. Since the regulating member of the large-sized type of the sheet accommodating device is generally formed as a sheet metal member or a thin plastic product, it cannot help being made of flexible material.

In case that the position of the regulating member having such the large size is changed according to the size of a sheet, conventionally, the regulating member is detached at every change, then reattached to the size position of the sheet to be used and fixed there. Therefore, the regulating member of the large size is troublesome in that it is inserted into slits provided at each size of the sheets to be fixed and that it is fixed by a fixing member such as a screw, a magnets or the like.

SUMMARY OF THE INVENTION

An object of the invention is to provide a sheet accommodating device which is superior in operationality and also can position the regulating member accurately.

In order to achieve the above object, a sheet accommodating device comprises a table on which sheets are stacked; a first pinion rotatably disposed at a center of the table; a second pinion rotatably disposed on one end side of the table; a third pinion rotatably disposed on the other end side of the table; a fourth pinion that is connected to the second pinion and arranged above the second pinion; a fifth pinion that is connected to the third pinion and arranged above the third pinion; a first regulating member which is arranged on one side of the table and has rack portions that can be engaged with the first pinion, second pinion and fourth pinion; a second regulating member which is arranged so as to be opposite to the first regulating member and has rack portions that can be engaged with the first pinion, third pinion and fifth pinion; and lock means for positioning any one of the first and second regulating members.

DETAILED DESCRIPTION OF THE PRESENT INVENTION

An embodiment of a sheet accommodating device according to the invention will be described below in detail with reference to drawings.

Figure 1:
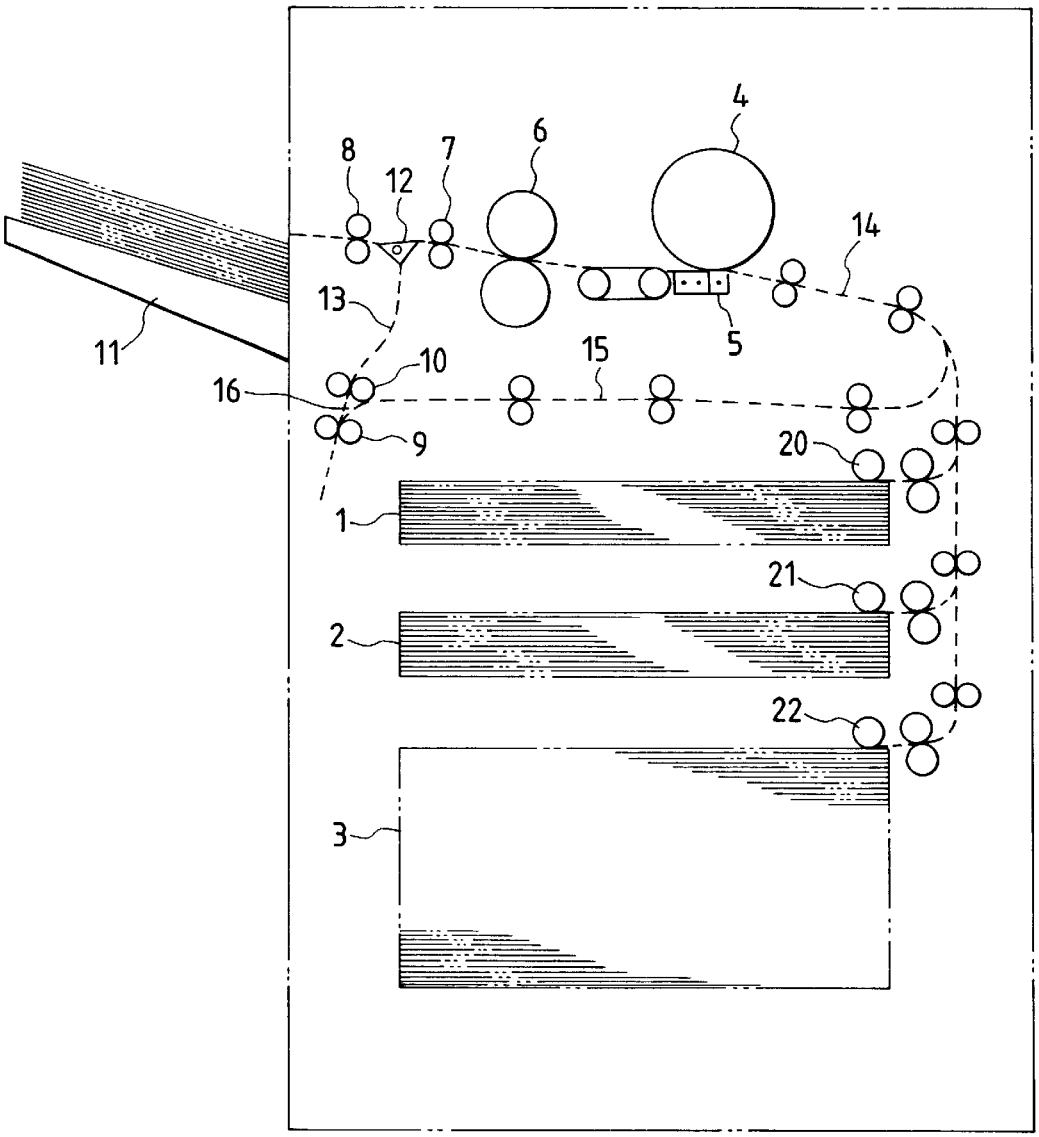
FIG. 1 is a whole constitutional view of a laser printer in which a sheet accommodating device of the invention is mounted.

FIG. 1 is a whole constitutional view of a laser printer in which a sheet accommodating device of the invention is applied to a paper supplying section. In FIG. 1, reference numerals 1, 2 and 3 are sheet accommodating devices, of which the sheet accommodating device 3 has a larger sheet capacity than the other sheet accommodating devices 1 and 2 and can supply a large amount of sheets to the laser printer. The sheet accommodating devices 1, 2 and 3 can be drawn out in the direction perpendicular to a sheet surface of FIG. 1. When the sheet accommodating devices are put into their predetermined attaching positions and mounted in a main body of the printer, optical sensors (not shown) detect the mounting of each sheet supplying device and then the sheet supplying devices engage with elevator table driving gears (not shown), so that elevator tables are raised till the top surfaces of sheets stacked on the elevator tables (the upper surfaces of the elevator tables in case that there are no sheets on the elevator tables) come into contact with the paper feed rollers 20, 21 and 22.

Reference numeral 4 represents a photosensitive drum, which starts rotating in accordance with signals from a controller (not shown). As the photosensitive drum 4 starts rotating, a surface of the photosensitive drum 4 is uniformly charged by a corona charger (not shown). On the charged photosensitive drum 4, an electrostatic latent image is formed by an optical system (not shown). When the electrostatic latent image reaches a position of a developing device (not shown), it is developed by toner and made visible on the photosensitive drum 2 as a toner image. The toner image thus formed by the known electrophotographic process is transferred onto the sheet fed out from a sheet tray 1, 2 or 3 by a transfer unit 5. Reference numeral 6 is a fixing device, by which the toner image transferred on the sheet is fixed. Reference numeral 12 is a gate member for switching directions of sheets to be transported, and 11 is a paper exhausting tray on which sheets on which images have already been formed are stacked.

Reference numeral 14 is a paper feeding passage communicating with paper supplying sections 1, 2 and 3; image forming means 4, 5, and 6; and the paper exhausting tray 11. Reference numeral 13 is a paper drawn-in passage, which diverges from the paper feeding passage 14 downstream in the paper transporting direction with respect to the image forming means 4, 5 and 6, and selectively draws the sheet fed out from the fixing device 6 therein by switching of the gate member 12. Reference numeral 15 is a return passage which diverges from the paper drawn-in passage 13, and of which an end joins the paper feeding passage 14 upstream in the paper transporting direction with respect to the image forming means 4, 5 and 6.

Accordingly, in case that printing is performed on both sides of the sheet, the sheet fed out from the fixing device 6 is drawn in the paper drawn-in passage 13 and then this sheet is fed out to the return passage 15, whereby the sheet on which recording has been performed on one side is again fed out to the image forming means, so that two-sided recording is executed. In FIG. 1, reference numerals 7 and 8 are feed rollers provided before and after the gate member 12; 9 and 10 are feed rollers, in which forward rotation and backward rotation can be switched, and their rollers 9 and 10 are provided on the paper drawn-in passage 13; and 16 is a gate member for guiding the sheet drawn in the drawn-in passage 13 to the return passage 15 or guiding the sheet drawn in the drawn-in passage 13 again to the paper feeding passage 14.

Figure 2:
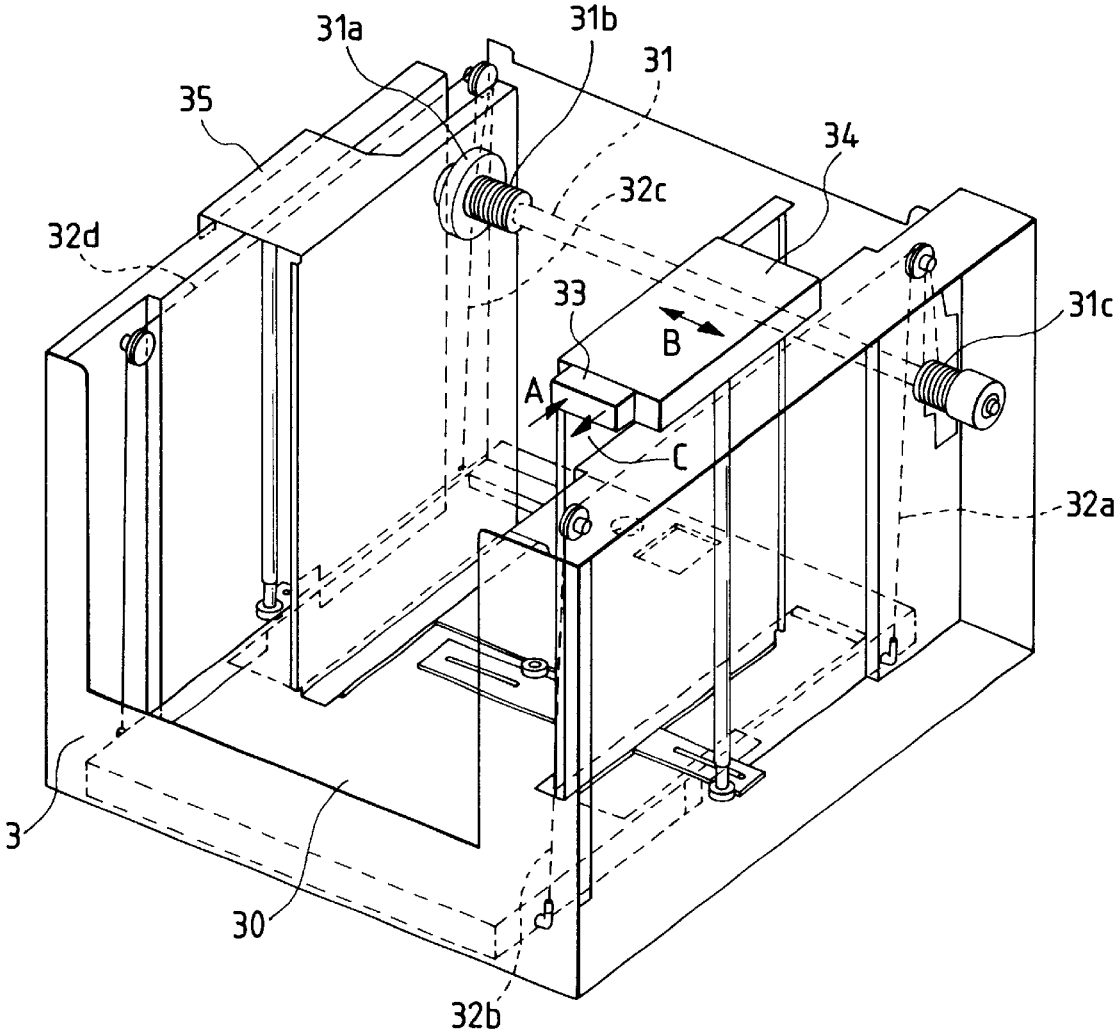
FIG. 2 is a schematic perspective view showing one embodiment of the sheet accommodating device of the invention.
Figure 3:
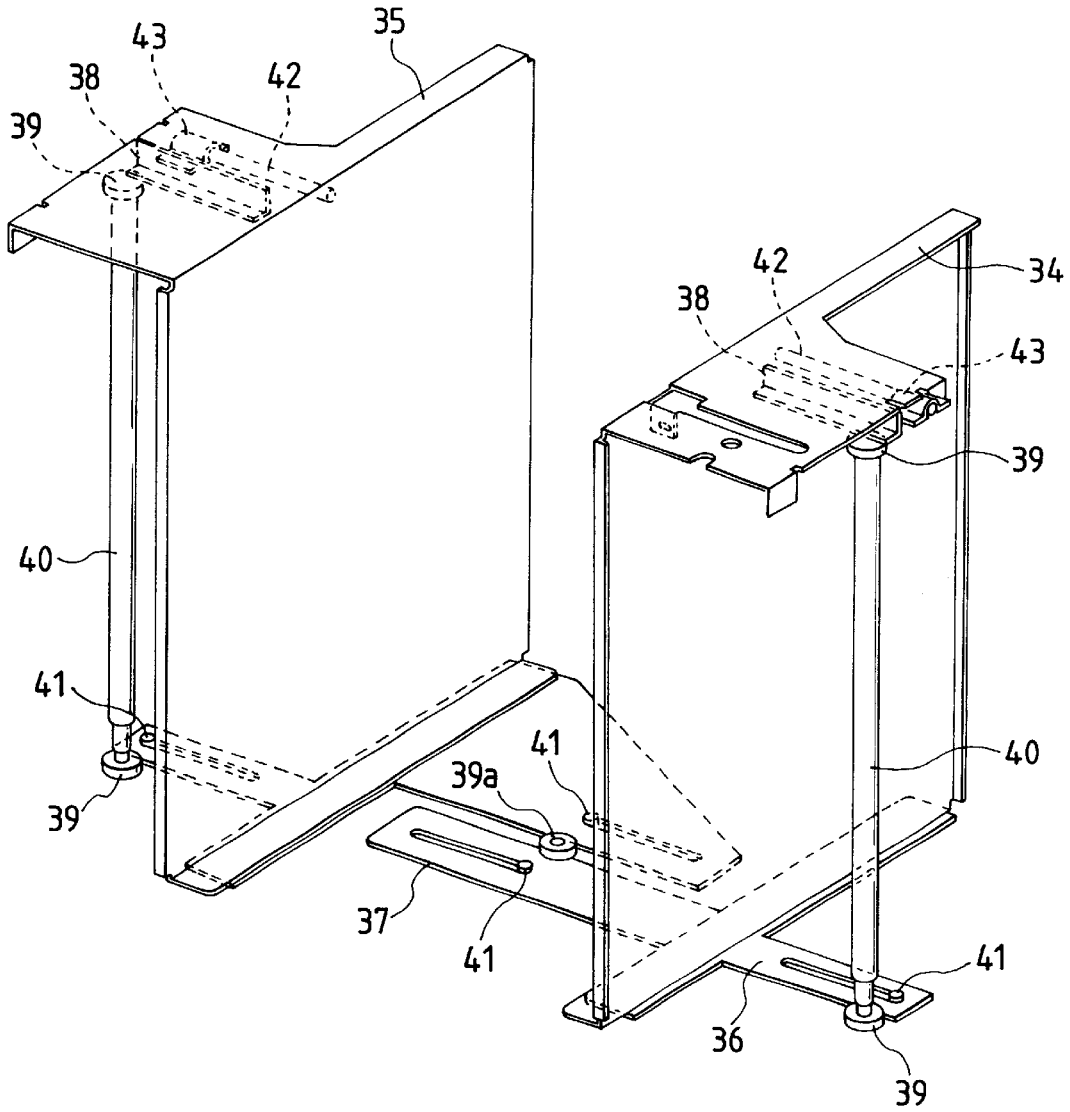
FIG. 3 is a constitutional view showing a slide mechanism of a regulating member in the sheet accommodating device of the invention.
Figure 4:
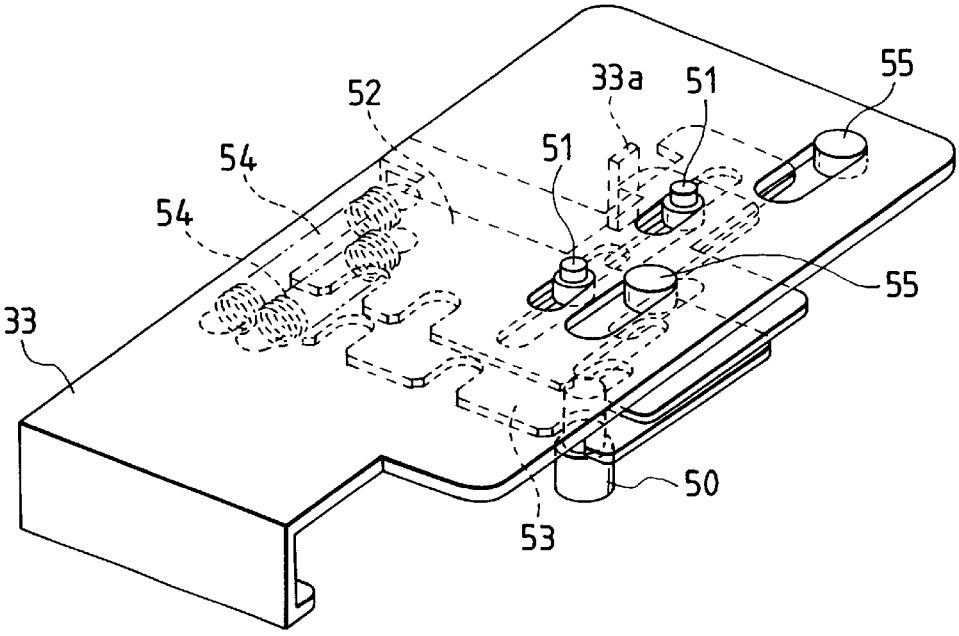
FIG. 4 is a constitutional view showing a lock mechanism of the regulating member in the sheet accommodating device of the invention.

Next, the constitution of the sheet accommodating device will be described with reference to FIGS. 2, 3 and 4. FIG. 2 is a schematic perspective view of the sheet accommodating device 3, FIG. 3 is a detail view of a slide mechanism of the regulating member, and FIG. 4 is an enlarged detail view of a lock mechanism of the regulating member.

In FIG. 2, reference numeral 3 represents a sheet accommodating device; 30 represents a table on which sheets are stacked; 31 represents a drive shaft attached to the sheet accommodating device; 31*a* represents a transmission gear that is engaged with an elevator table driving gear (not shown) disposed on the main body and transmits power to the drive shaft 31; 31*b* and 31*c* represent wire drums for winding up wires that hang down the table 30; 32*a*, 32*b*, 32*c* and 32*d* represent wires that hang down the table 30; and 33 represents a release lever for releasing lock of the regulating members 34 and 35.

Next, the slide mechanism of the regulating members 34 and 35 will be described with reference to FIG. 3. To the lower portion of each of the regulating members 34 and 35, racks 36 and 37 are attached, and to the upper portion thereof, a rack 38 is attached. In the racks 36 and 37, the rack portions which project outside the regulating members 34 and 35 are engaged with pinions 39 rotatably supported by the sheet accommodating device 3, while rack portions which project inside the regulating members 34 and 35 are engaged with a pinion 39*a* rotatably supported at the center of the sheet accommodating device 3 in such a manner that the rack portions use the pinion 39*a* in common. Further, in the racks 36 and 37, pinion shafts 40 are coupled to the upper portions of the pinions 39, and a pinions 39 disposed at the upper ends of the pinion shafts 40 are engaged with the racks 38 provided at the upper portions of the regulating members 34 and 35.

The racks 36 and 37 are regulated in the sliding directions by guide pins 41 fixed to the sheet accommodating device 3 and can be slid only in the direction B of FIG. 2. Guide shafts 42 provided at the upper portions of the regulating members 34 and 35 are inserted into support members 43 fixed to the sheet accommodating device 3, and can be slid only in the direction B of FIG. 2.

As described above, the regulating members 34 and 35 of the large size are slidably supported by the racks and the pinions in the upper portions and the lower portions thereof. Therefore, flexure is suppressed and the regulating members 34 and 35 are held firmly. Further, by sliding the release lever 33 in the direction A to release the lock, the regulating member 34 can be slid in the direction B of FIG. 2, so that the regulating member 35 is slid in accordance with the sliding movement of the regulating member 34.

Next, the lock mechanism of the regulating members 34 and 35 will be described with reference to FIG. 4. Grooves engaged with a lock pin 50 fixed to the regulating member 34 are formed in positioning plates 52 and 53. Here, the grooves are formed respectively in the positioning plates 52 and 53 at the different position from each other. The two positioning plates are used in piles, whereby it is possible to finely set the lock position at a narrower pitch than the outer diameter of the lock pin 50. Further, the number of the positioning plates is not limited to two, and increase of the number of the positioning plates can cause increase of the lock position. The positioning plates 52 and 53 are regulated in the sliding direction thereof by a guide pin 51 fixed to the regulating member 34, and they are attached so that they can be slid only in the directions A and C of FIG. 2.

Further, a tension coil springs 54 are respectively attached to the positioning plates 52 and 53, and they give urging force by which the grooves of the positioning plates 52 and 53 are engaged with the lock pin 50. The release lever 33 is regulated in the sliding direction thereof by a guide pin 55 attached to the regulating member 34, and attached so that it can be slid only in the directions A and C of FIG. 2. A release lever rib 33*a* attached to the release lever 33 is engaged with the positioning plates 52 and 53 and moves in accordance with the slide of the release lever 33 so that it slides the positioning plates 52 and 53 in the directions A and C of FIG. 2, whereby engagement and disengagement between the grooves of the positioning plates 52, 53 and the lock pin 50 are performed.

Figure 5:
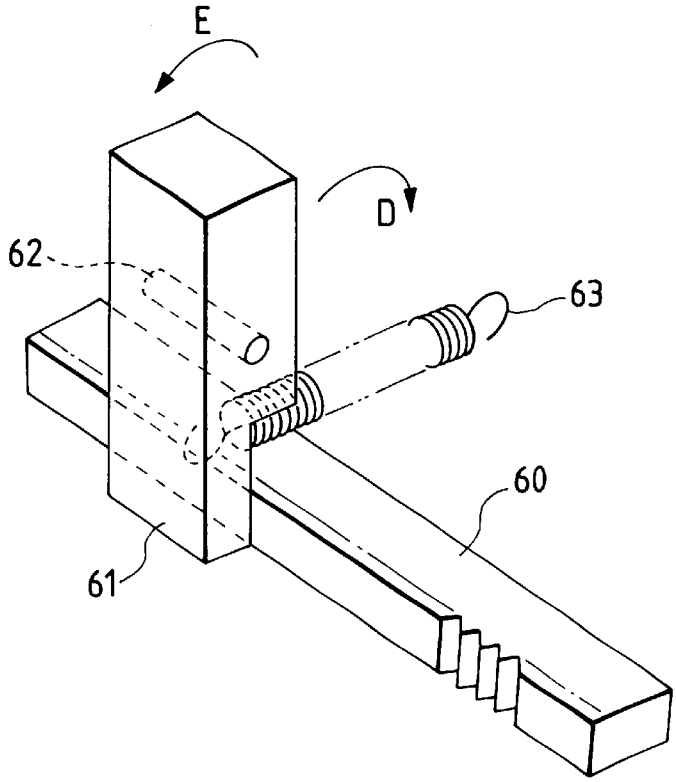
FIG. 5 is a constitutional view showing another embodiment of the lock mechanism.

In this connection, the lock mechanism can have various designs other than the design shown in FIG. 4. For example, as shown in FIG. 5, a release lever 61 is provided for the regulating member 34 and rotated by a tension coil spring 63 in the direction E of FIG. 5 round a support pin 62, and a groove formed in the release lever 61 is engaged with a groove forming member 60 attached to the sheet accommodating device 3, whereby the regulating member 34 may be fixed. By rotating the release lever 61 in the direction D of FIG. 5, the engagement between the release lever 61 and the groove forming member 60 is released, so that the regulating member 34 can be moved in the direction B of FIG. 2.

As described above, according to the invention, it is possible to provide a sheet accommodating device which is superior in operationality and also can position the regulating member accurately.

What is claimed is:

1. A sheet accommodating device comprising:

a table on which a sheet is stacked;

a first pinion rotatably disposed at a center of the table;

a second pinion rotatably disposed on one end side of the table;

a third pinion rotatably disposed on the other end side of the table;

a fourth pinion connected to the second pinion and arranged above the second pinion;

a fifth pinion connected to the third pinion and arranged above the third pinion;

a first regulating member disposed on one side of the table, the first regulating member having a first rack portion projecting inside the first regulating member and engagable with the first pinion;

a second regulating member facing the first regulating member, the second regulating member having a second rack portion engagable with the first pinion; and a lock for positioning any one of the first and second regulating members.

2. The sheet accommodating device as claimed in claim 1, wherein the lock comprises a positioning plate having a groove, any one of the first and second regulating members has a lock pin to be engaged with the groove of the positioning plate, and the lock pin prevents the one of the first and second regulating means from moving except for a predetermined direction.

3. The sheet accommodating device as claimed in claim 2, wherein the lock comprises a coil spring for engaging the lock pin with the groove of the positioning plate.

4. The sheet accommodating device as claimed in claim 2, wherein the lock comprises a release lever for releasing the engagement of the lock pin with the groove of the positioning plate.

5. The sheet accommodating device as claimed in claim 1, wherein the second regulating member is engagable with the first pinion through the second rack portion projecting inside the second regulating member.

6. A sheet accommodating device comprising:

a table on which a sheet is stacked;

a first pinion rotatably disposed within a central portion of the table;

a second pinion rotatably disposed on one end side of the table;

a third pinion rotatably disposed on the other end side of the table;

a fourth pinion connected to the second pinion and arranged above the second pinion;

a fifth pinion connected to the third pinion and arranged above the third pinion;

a first regulating member disposed on one side of the table, the first regulating member having a first rack portion projecting inside the first regulating member and engagable with the first pinion; and a second regulating member facing the first regulating member, the second regulating member having a second rack portion engagable with the first pinion.

7. The sheet accommodating device as claimed in claim 6, wherein the second regulating member is engagable with the first pinion through the second rack portion projecting inside the second regulating member.

8. The sheet accommodating device as claimed in claim 7, wherein the fourth pinion is connected to the second pinion by a shaft so as to rotate with the second pinion.

9. The sheet accommodating device as claimed in claim 8, wherein the fifth pinion is connected to the third pinion by a shaft so as to rotate with the third pinion.

10. The sheet accommodating device as claimed in claim 8, further comprising a lock for locking in a position one of the first and second regulating members.

11. The sheet accommodating device as claimed in claim 6, wherein the first regulating member further comprises a third rack portion projecting outside the first regulating member and engaged with the fourth pinion.

12. The sheet accommodating device as claimed in claim 11, wherein the second regulating member further comprises a fourth rack portion projecting outside the second regulating member and engaged with the fifth pinion.

* * * * *